US006533234B2

(12) United States Patent
Dervaes

(10) Patent No.: US 6,533,234 B2
(45) Date of Patent: Mar. 18, 2003

(54) SELF-CENTERING SYSTEM

(75) Inventor: Nelson E. Dervaes, Ft. Collins, CO (US)

(73) Assignee: Hach Company, Loveland, CO (US)

( * ) Notice: Subject to any disclaimer, the term of this patent is extended or adjusted under 35 U.S.C. 154(b) by 0 days.

(21) Appl. No.: 09/952,976

(22) Filed: Sep. 14, 2001

(65) Prior Publication Data

US 2002/0040618 A1 Apr. 11, 2002

Related U.S. Application Data

(60) Provisional application No. 60/236,669, filed on Sep. 29, 2000.

(51) Int. Cl.[7] ..... A47G 1/10
(52) U.S. Cl. ..... 248/316.3
(58) Field of Search ..... 248/316.3, 316.2, 248/229.11, 229.21, 228.2, 230.2, 111, 113

(56) References Cited

U.S. PATENT DOCUMENTS 369,318 A * 9/1887 Craine ..... 248/113
1,563,817 A * 12/1925 Wright ..... 248/113
1,589,616 A * 6/1926 Alford ..... 248/113
5,183,164 A * 2/1993 Heinzle ..... 211/70.5
5,417,335 A * 5/1995 White ..... 211/70.5
6,105,915 A * 8/2000 Naman et al. ..... 211/70.5

* cited by examiner

*Primary Examiner*—Ramon O. Ramirez
*Assistant Examiner*—Kofi Schulterbrandt
(74) *Attorney, Agent, or Firm*—Dean P. Edmundson

(57) ABSTRACT

A self-centering system is described for holding an object (e.g. a vial, tube or cell) to maintain the longitudinal axis of the object in the desired orientation. The system includes two cam members which are pivotably mounted on parallel axes. The cam members include sloped surfaces which are able to accommodate objects of various diameters or shapes (e.g. circular or non-circular cross-section). The cam members are biased (e.g. with weights or springs) such that the sloped surfaces are automatically brought into contact with the object to be oriented and supported.

5 Claims, 6 Drawing Sheets

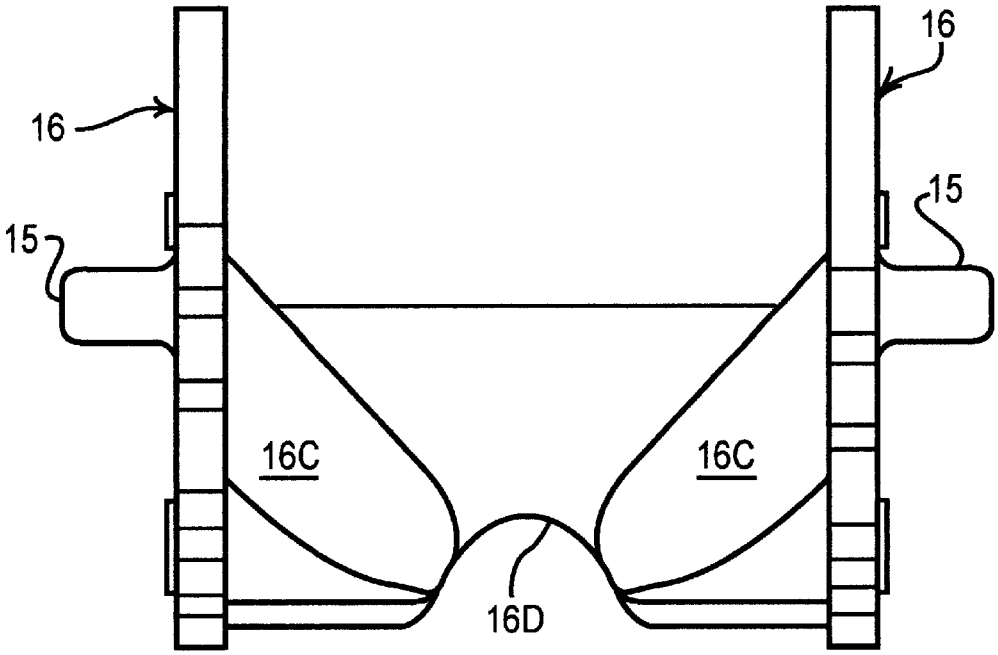
FIGURE 4
FIGURE 5
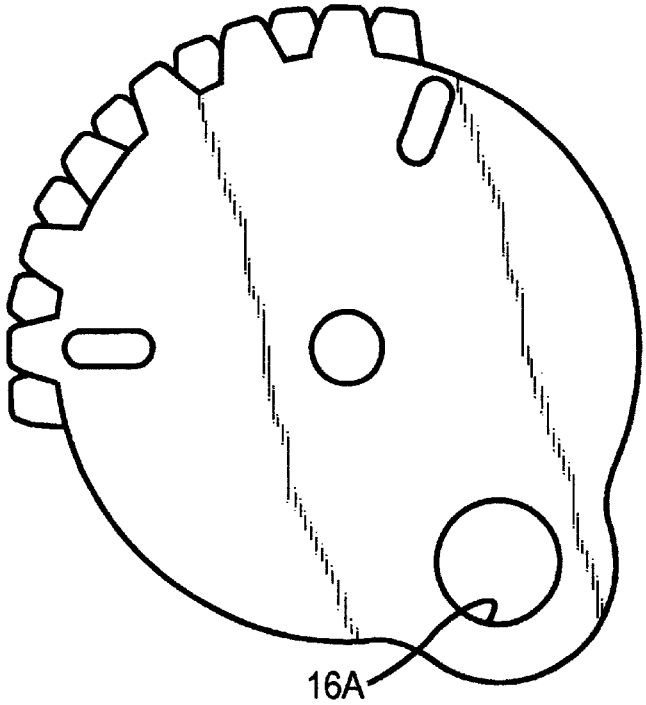

SELF-CENTERING SYSTEM

CROSS-REFERENCE TO RELATED APPLICATION

This application is based upon, and claims the benefit of, my Provisional Application No. 60/236,669, filed Sep. 29, 2000.

FIELD OF THE INVENTION

This invention relates to a self-centering system. More particularly, this invention relates to a self-centering system for holding elongated objects in a manner which maintains their longitudinal axis in the proper orientation.

BACKGROUND OF THE INVENTION

There are many situations where it is necessary or desirable to be able to hold or position an object and maintain proper orientation of the longitudinal axis of the object. For example, in many scientific instruments a vial or tube containing a sample to be tested must be inserted into the instrument at a specific location. It is also necessary to maintain proper orientation of the vial or tube in the instrument during the testing. For example, when the testing involves passing a light beam through the vial, the vial must be maintained in a proper location with respect to the path of the light beam (i.e. the vial must be centered with respect to the light beam).

Although various types of cell or vial holders have been previously used, none of them have the capability of automatically centering vials or cells of different diameters within a particular location in an instrument.

SUMMARY OF THE INVENTION

In accordance with the present invention there is provided a self-centering system for holding an object (e.g. a vial, tube or cell) to maintain the longitudinal axis in the desired orientation.

The self-centering system of the invention is especially useful in scientific instruments where a vial or cell must be supported in a vertical position and centered with respect to a particular location. For example, in some instruments which are currently used for optical testing, a separate sample cell holder must be used for each vial diameter. However, with the self-centering system of this invention, each different vial will be automatically centered in the holder so that the vial is in the proper position with respect to the path of the light beam.

In a preferred embodiment, the self-centering system comprises a pair of cam members which are each adapted to rotate about a horizontal axis. Tapered surfaces along the cam members enable the cam members to accommodate vials or tubes of different diameters. The cam members are interconnected (e.g. with meshing teeth members) so that when a vial or tube is inserted between the facing cam members, the surfaces of the two cam members rotate away from each other in a manner that the vial or tube remains properly centered between the cam members, regardless of the particular diameter of the vial or tube.

The self-centering system is adaptable to other types of objects besides vials or tubes (e.g. rods, wires, etc.).

Other features and advantages of the self-centering system of this invention will be apparent from the following detailed description and the accompanying drawings.

BRIEF DESCRIPTION OF THE DRAWINGS

The invention is described in more detail hereafter with reference to the accompanying drawings, wherein like reference characters refer to the same parts throughout the several views and in which:

FIG. 4 is a bottom view of the cam member shown in FIG. 3;

FIG. 5 is a side elevational view of the cam member shown in FIG. 3;

DETAILED DESCRIPTION OF THE INVENTION

Figure 1:
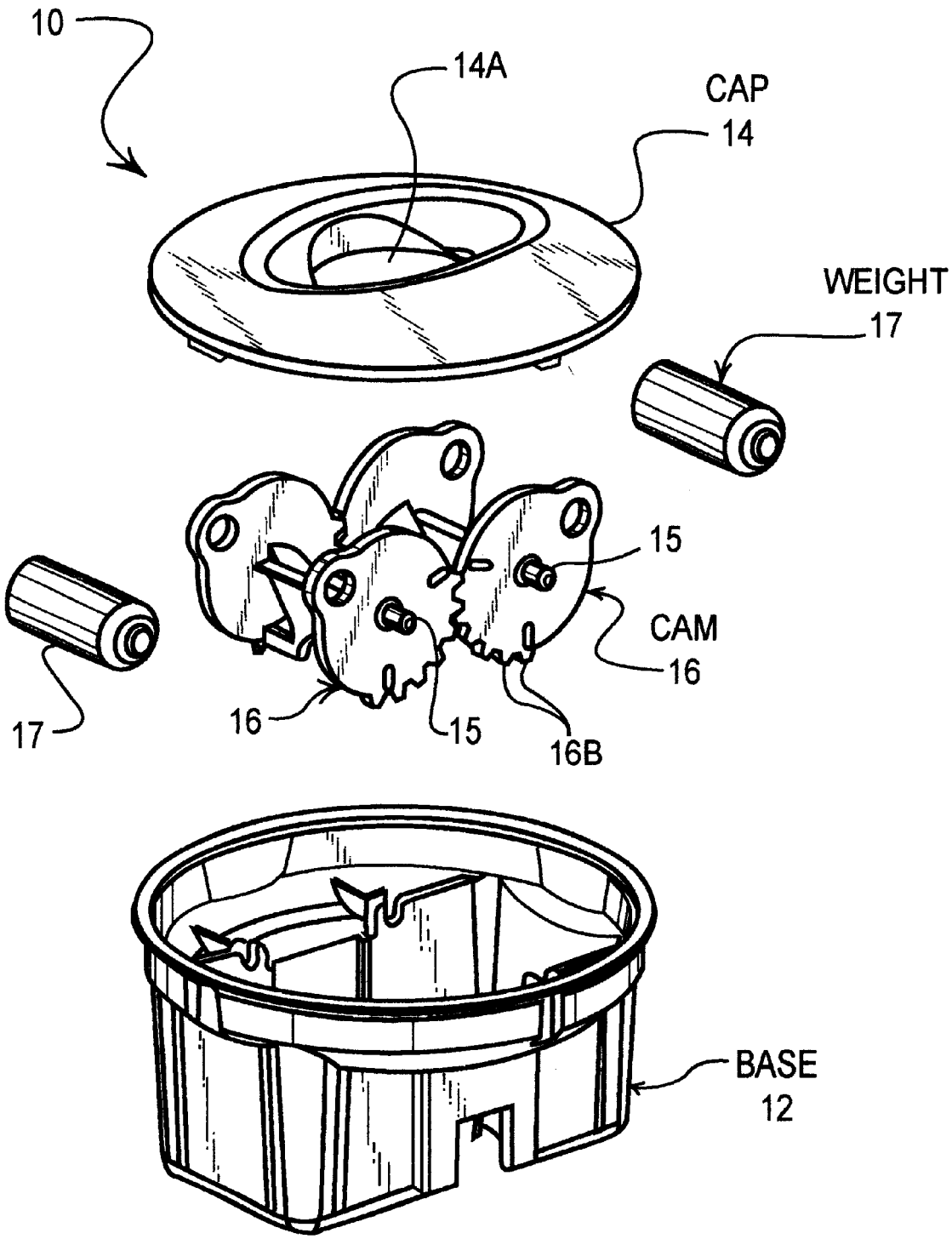
FIG. 1 is an exploded view of a cell holder for use in a scientific instrument which includes the self-centering system of the invention.
Figure 2:
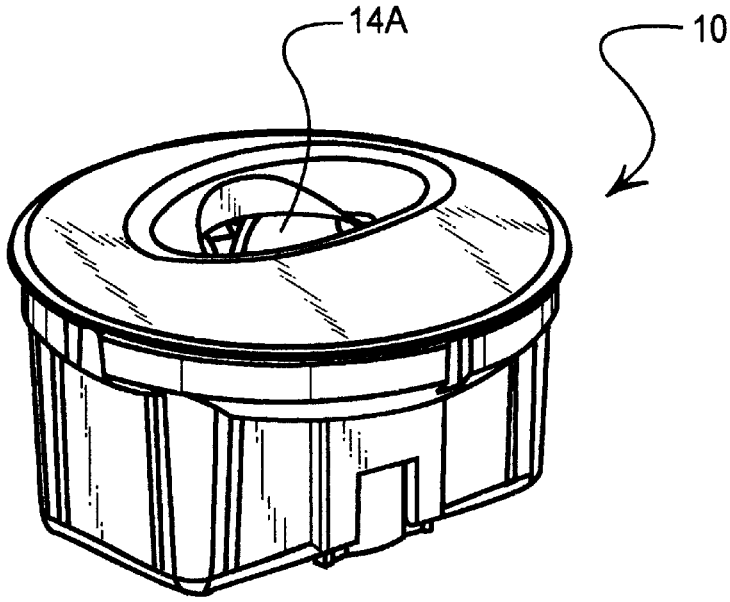
FIG. 2 is a perspective view of the assembled cell holder shown in FIG. 1.
Figure 3:
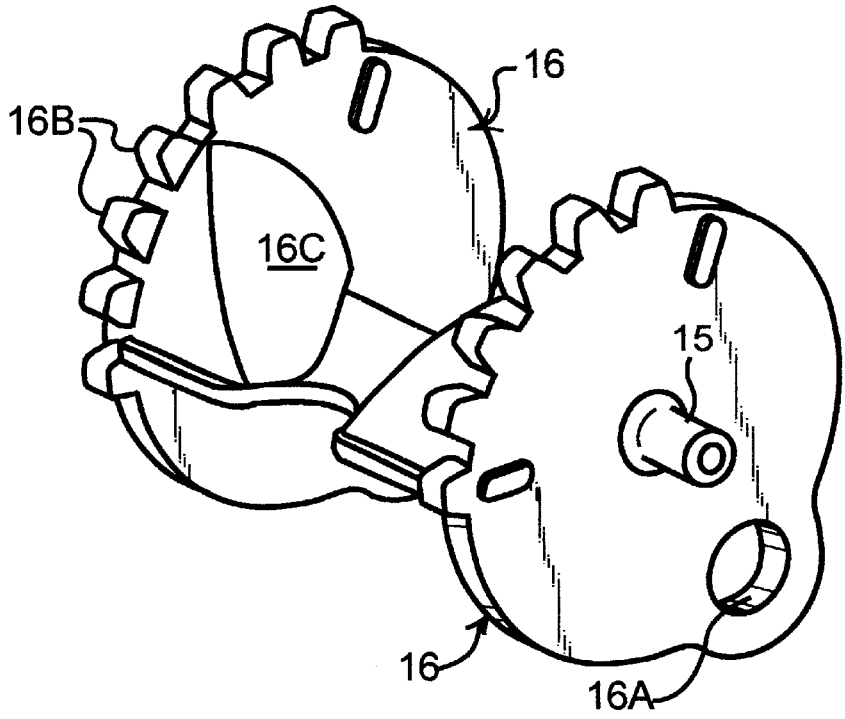
FIG. 3 is a perspective view of one cam member used in the system of the invention.
Figure 6:
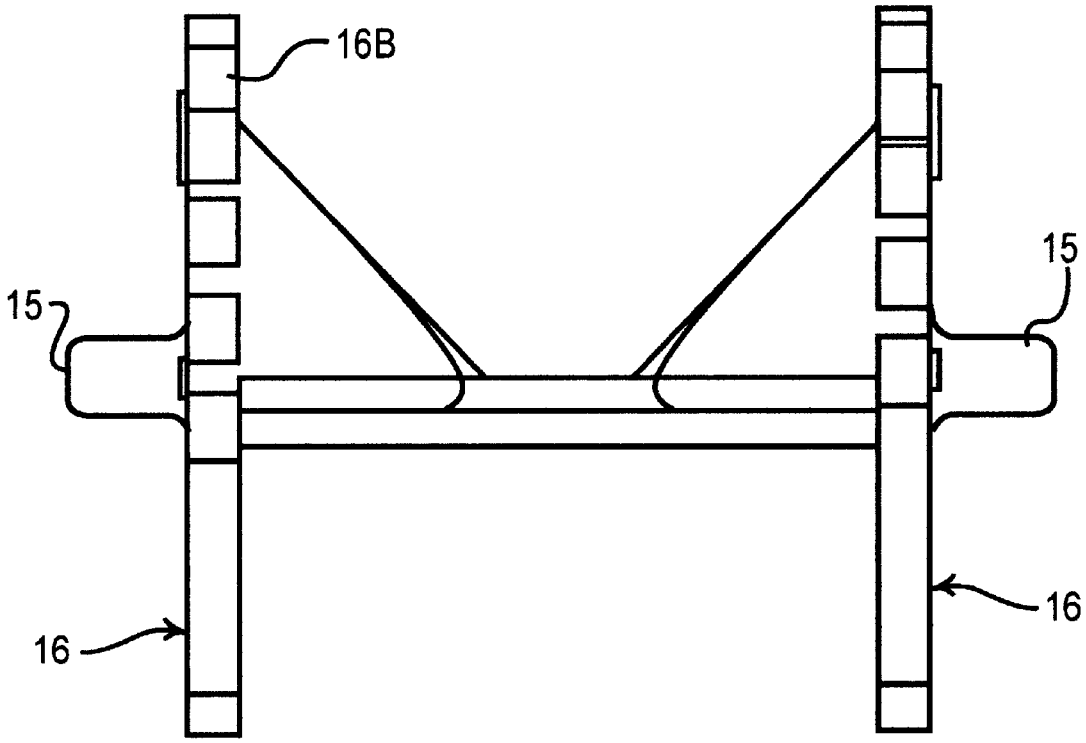
FIG. 6 is a top view of the cam member shown in FIG. 5.

In the drawings there is shown a self-centering system 10 of the invention comprising two cam members 16 which are each adapted to rotate about a horizontal axis 15. The cam members each include end pieces with teeth 16B. The teeth on the cam members are adapted to mesh to assure that rotational movement of one cam member causes the other cam member to rotate in an opposing direction but with the same degree of rotation.

Counter weights 17 on the cam members are for the purpose of causing the sloped surfaces 16C on each cam member to rotate towards the corresponding sloped surfaces on the opposing cam member. Thus, when a vial or tube is inserted into the area between the cam members, the weights 17 cause the sloped surfaces 16C on the cam members to be urged against the surface of the vial or tube. This force keeps the vial or tube properly centered between the two cam members. The opposite ends of each weight 17 are captured in openings 16A at the outer edge of each cam member. Instead of using weights to bias the cam members to a certain position, it is possible to use springs or any device or mechanism that will cause the cams to rotate to the closed position.

For use in a cell holder of a scientific instrument, the cam members are positioned within a base or housing 12 and a cap 14 is positioned over the top. The cap includes a central opening 14A to enable a vial or tube to be inserted therein.

As illustrated in FIG. 4, the sloped surfaces 16C on each cam member taper toward an opening 16D. When the cam members are at their normal rest position, the tapered surfaces of the two cam members form the smallest effective diameter desired to be held by the device. They also act as a guide, leading the tube or vial, etc. into the proper position, centered between the cams. As a cell of larger diameter is inserted, each cam will rotate the proper angle until the opening created by the tapered cam surfaces 16C matches the cell diameter. At that point the cams will cease to rotate and the weights will apply a holding force.

Figure 7:
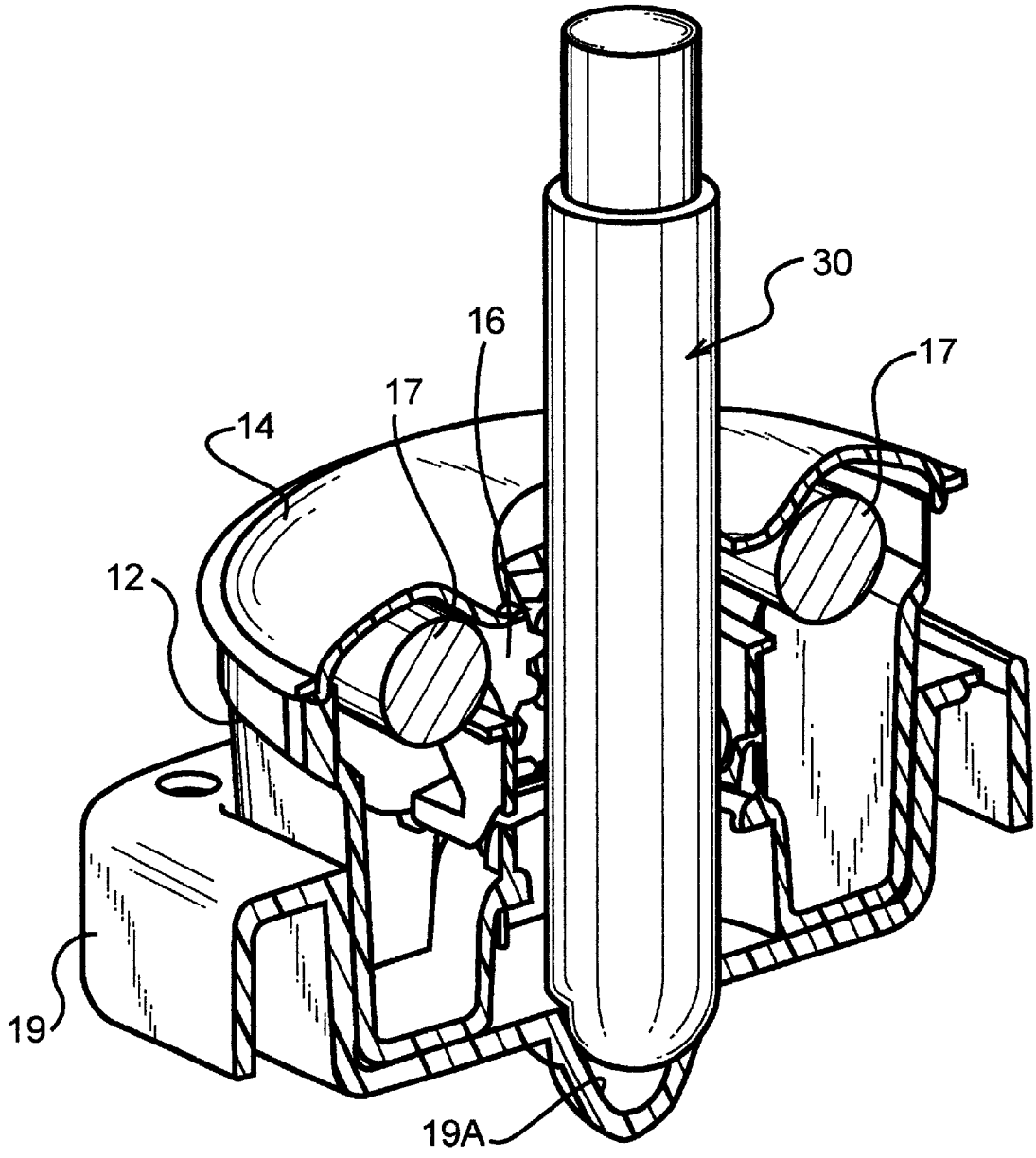
FIG. 7 is a perspective view, partially cut-away, of the cell holder of FIG. 2 with a vial positioned and supported within the holder.
Figure 8:
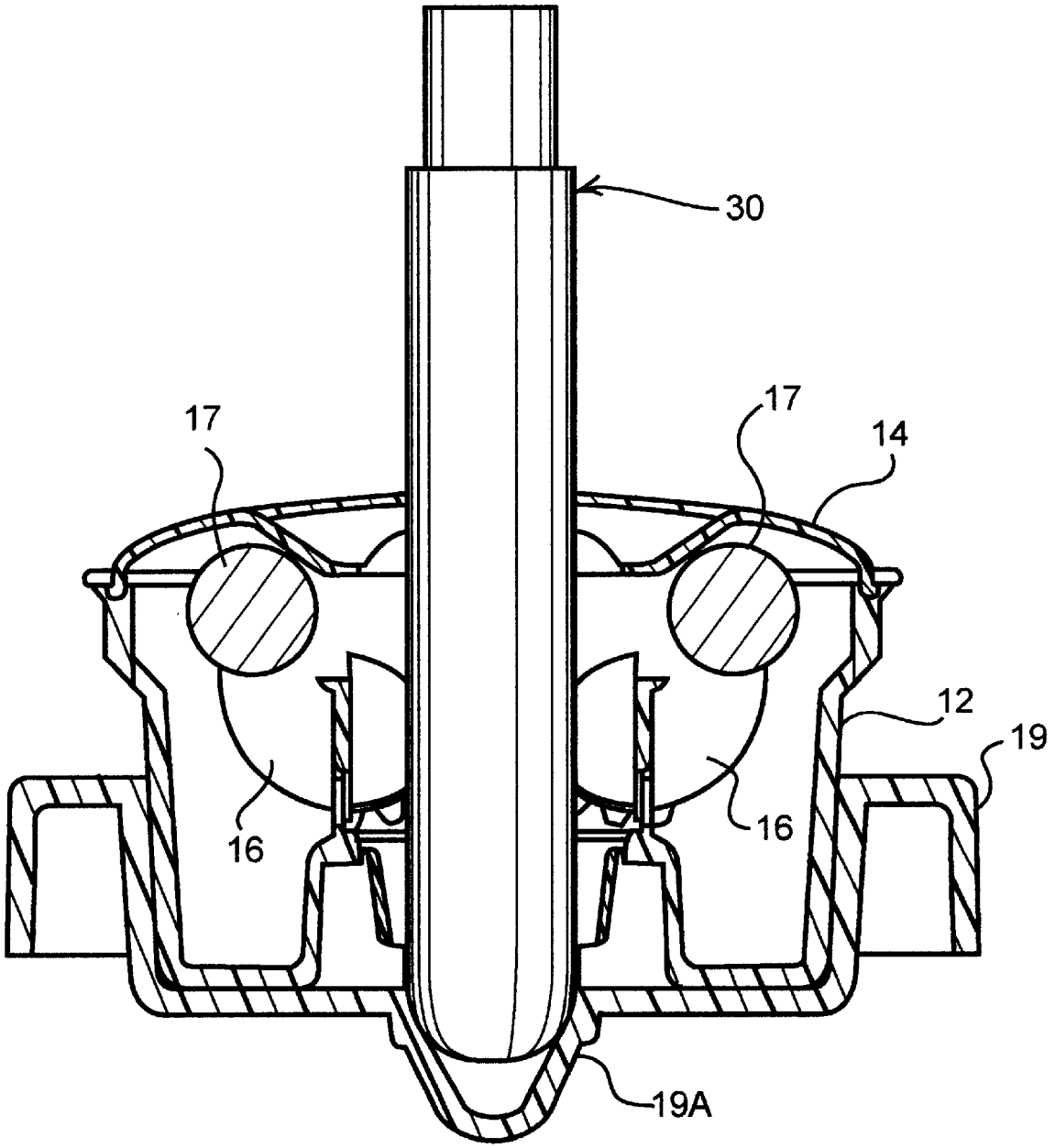
FIG. 8 is a cross-sectional view of the cell holder of FIG. 2 with a vial or tube supported therein.

FIGS. 7 and 8 illustrate the manner in which a vial or tube 30 is supported and held in the holder. The cell holder 12 is positioned in a base 19 which includes a central recess area 19A in which the lower end of the vial or tube 30 rests when fully inserted into the holder. The cam members support the upper portion of the vial or tube, as shown. The central access area 19A could also be part of the cell holder base 12.

Thus, the self-centering system effectively centers and holds a vial or tube in the proper position so that it is always centered with respect to a light beam that may be passed through the holder. Because the cam members are symmetrically shaped and meshed together, they will assure that the tube or vial is always centered regardless of the diameter of the tube or vial.

Because there is a direct correlation between the rotational position of the cam members in the cell holder and the diameter of the sample vial, sensors may be added so that the instrument could easily determine which size cell or vial had been inserted into the holder. This would allow the instrument to have a simple auto-cell detection system.

Other variants are possible without departing from the scope of this invention. For example, the self-centering system is also useful in holding any object that is similar in shape to a cylinder (but not necessarily round). It could be used to hold machining stock, tools, beakers, bottles, etc. where it is necessary to maintain the longitudinal axis of the object centered with respect to a given location.

What is claimed is:

1. A self-centering system comprising first and second cam members which are adapted to rotate about first and second parallel axes, respectively, and which each include sloped surfaces; wherein each said cam member further comprises a weight which is carried by said cam member opposite said sloped surfaces; wherein the cam members are adapted to rotate in opposite directions to the same degree to center and support an object positioned between the cam members, whereby said weight biases said sloped surfaces against said object.

2. The system in accordance with claim 1, wherein said sloped surfaces of said cam members are capable of adjusting automatically to the diameter and shape of said object positioned between said cam members.

3. The system in accordance with claim 1, wherein said first and second cam members each further comprise a peripheral edge including teeth, wherein the teeth on said first cam member mesh with the teeth on said second cam member.

4. A self-centering system comprising first and second cam members which are adapted to rotate about first and second parallel axes, respectively, and which each include sloped surfaces; wherein the cam members are adapted to rotate in opposite directions to the same degree to center and support an object positioned between the cam members; and wherein each cam member further comprises bias means for biasing said sloped said cam member against said object.

5. The system in accordance with claim 4, wherein said sloped surfaces of said cam members are capable of adjusting automatically to the diameter and shape of said object positioned between said cam members.

* * * * *